US006807953B1

(12) United States Patent
Liao

(10) Patent No.: US 6,807,953 B1
(45) Date of Patent: Oct. 26, 2004

(54) MAGNETIZED DEVICE FOR AN AUTOMOBILE FUELING SYSTEM

(76) Inventor: Chun-yao Liao, No. 159, Lane 247, Ta Chiao 1st St., Yung Kang City, Tainan Hsien (TW)

( * ) Notice: Subject to any disclaimer, the term of this patent is extended or adjusted under 35 U.S.C. 154(b) by 0 days.

(21) Appl. No.: 10/816,867

(22) Filed: Apr. 5, 2004

(51) Int. Cl.[7] ..... F02M 33/00
(52) U.S. Cl. ..... 123/538; 210/222; 335/306
(58) Field of Search ..... 335/302–306; 123/538; 210/222

(56) References Cited

U.S. PATENT DOCUMENTS 4,935,133 A * 6/1990 Hirama ..... 210/222
6,247,459 B1 * 6/2001 Liao ..... 123/538

* cited by examiner

*Primary Examiner*—Ramon M. Barrera
(74) *Attorney, Agent, or Firm*—Rosenberg, Klein & Lee

(57) ABSTRACT

A magnetized device for an automobile fueling system includes a sleeve, a pair of nozzles, a pair of semi-circular permanent magnets, and a pair of semi-circular guiding brackets. The permanent magnets and the guiding brackets are enclosed in the sleeve. The sleeve comprises inner threads at respective ends adapted to connect with two nozzles. Each nozzle has a hollow pipeline axially extending from one end while the other end is a reduced neck with threads thereon. The two guiding brackets are magnetized to wrap the permanent magnets, so that saw-shaped edges of the two guiding brackets are to form two gasoline routes to prolong the magnetization of gasoline.

4 Claims, 6 Drawing Sheets

MAGNETIZED DEVICE FOR AN AUTOMOBILE FUELING SYSTEM

FIELD OF THE INVENTION

This invention relates to a magnetized device for an automobile fueling system, and more particularly to a design to magnetize gasoline thoroughly for easy burning purpose.

BACKGROUND OF THE INVENTION

Gasoline is one of the essential elements to operate the engine of an automobile. The gasoline is generally composed of pentane. This product is easy to burn, but it may cause burning not thoroughly and produces air pollution.

In view of this and many other shortcomings, the inventor has derived a magnetized device to prolong the magnetization duration for a better burning.

SUMMARY OF THE INVENTION

It is the primary object of the present invention to provide a magnetized device for an automobile fueling system, which exposes gasoline to a longer magnetization for a better burning effect.

It is another object of the present invention to provide a magnetized device for an automobile fueling system, which eliminates air pollution produced by gasoline not burning thoroughly.

It is a further object of the present invention to provide a magnetized device for an automobile fueling system, which is cost effectiveness.

DETAILED DESCRIPTION OF THE PREFERRED EMBODIMENT

Figure 1:
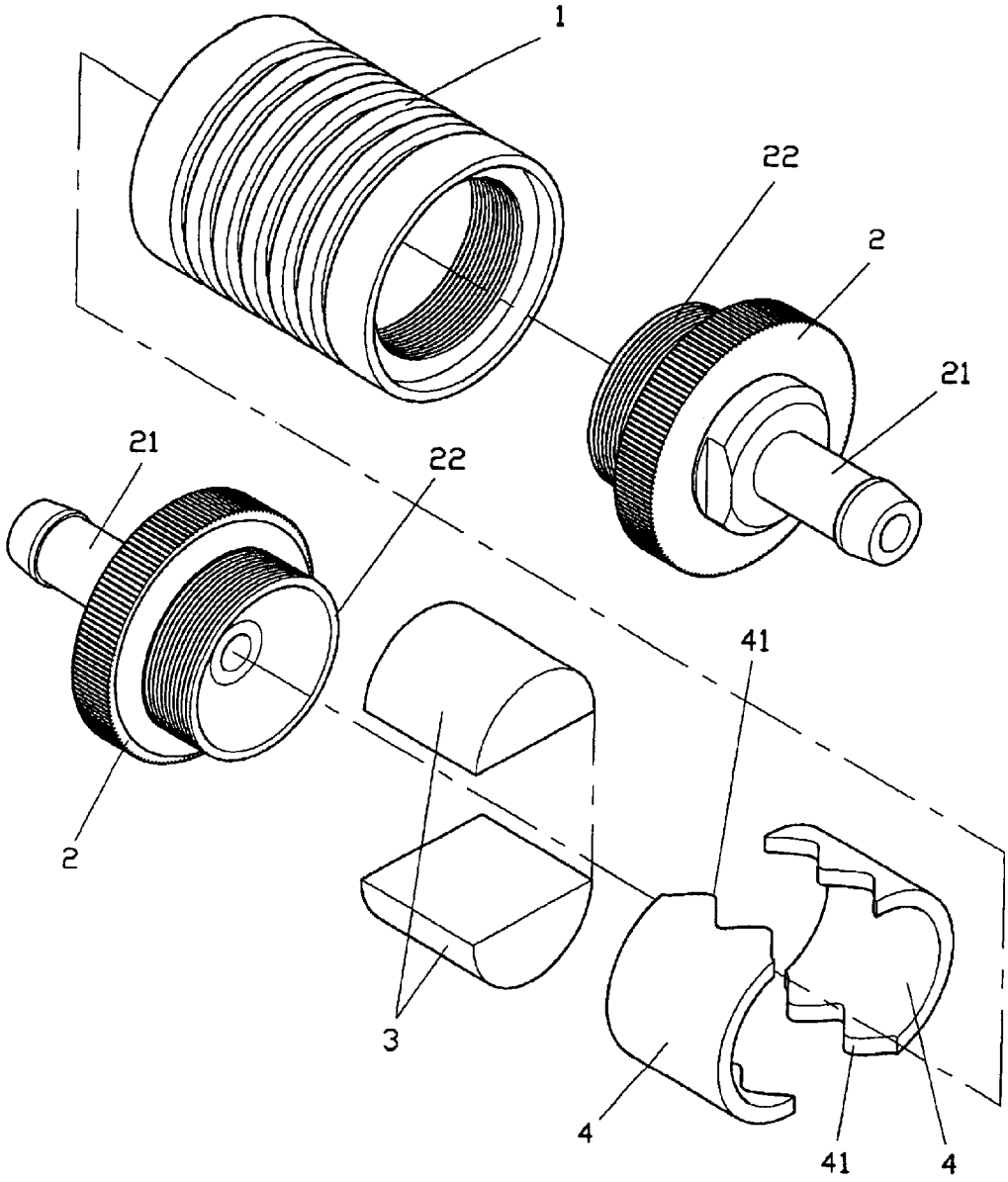
FIG. 1 is an exploded view of a first embodiment of the present invention.

The present invention comprises a sleeve 1, a pair of nozzles 2, a pair of semi-circular permanent magnets 3, and a pair of semi-circular guiding brackets 4, as shown in FIG. 1.

The sleeve 1 comprises inner threads at respective ends.

Each nozzle 2 has a hollow pipeline 21 axially extending from one end while the other end is a reduced neck 22 with threads thereon.

Each permanent magnet 3 is in a semi-circular piece and comprises a magnetic either positive or negative pole, while the other piece comprises an opposite pole.

Each of the guiding brackets 4 has a larger inner diameter with respect to the permanent magnet 3 and comprises two saw-shaped edges 41 at respective ends.

Figure 2:
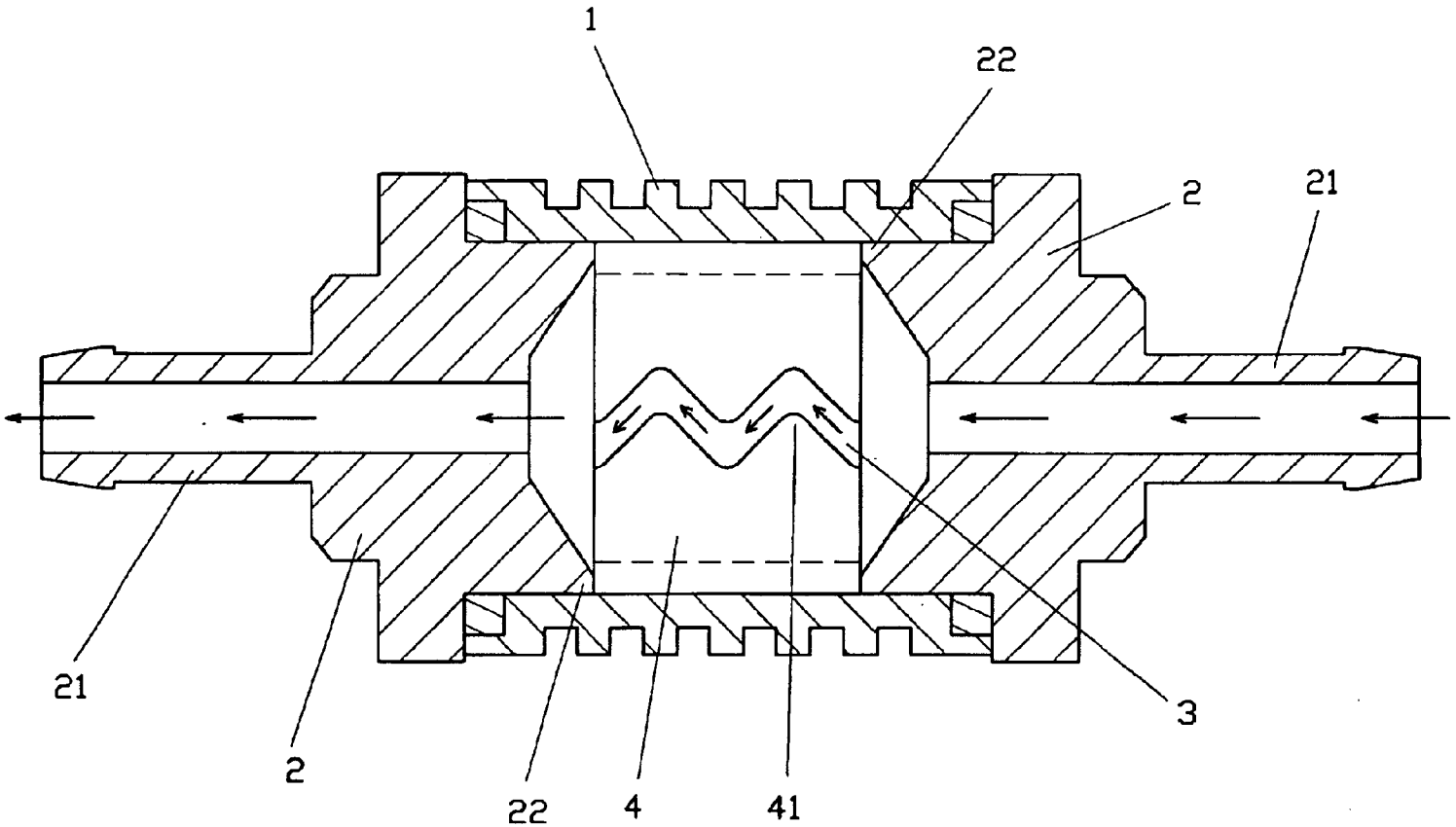
FIG. 2 is a side view with partial cross-sectioned.

In assembly, the two permanent magnets 3 are placed together to form a round entity, as shown in FIG. 2. The two guiding brackets 4 are magnetized to wrap the round entity of the permanent magnets 3 outwardly. The saw-shaped edges 41 of the guiding brackets 4 are to form two continuously curved gasoline routes at respective sides enclosed in the sleeve 1. The permanent magnets 3 and the guiding brackets 4 are placed into the sleeve 1. The two nozzles 2 are threaded with the sleeve 1 from respective sides of the sleeve 1. This holds the permanent magnets 3 and the guiding brackets 4 in the sleeve 1 securely with gasoline flowing through the gasoline routes formed by the guiding brackets 4. The permanent magnets 3 create a magnet field to proceed the magnetization of gasoline for burning purpose.

Figure 3:
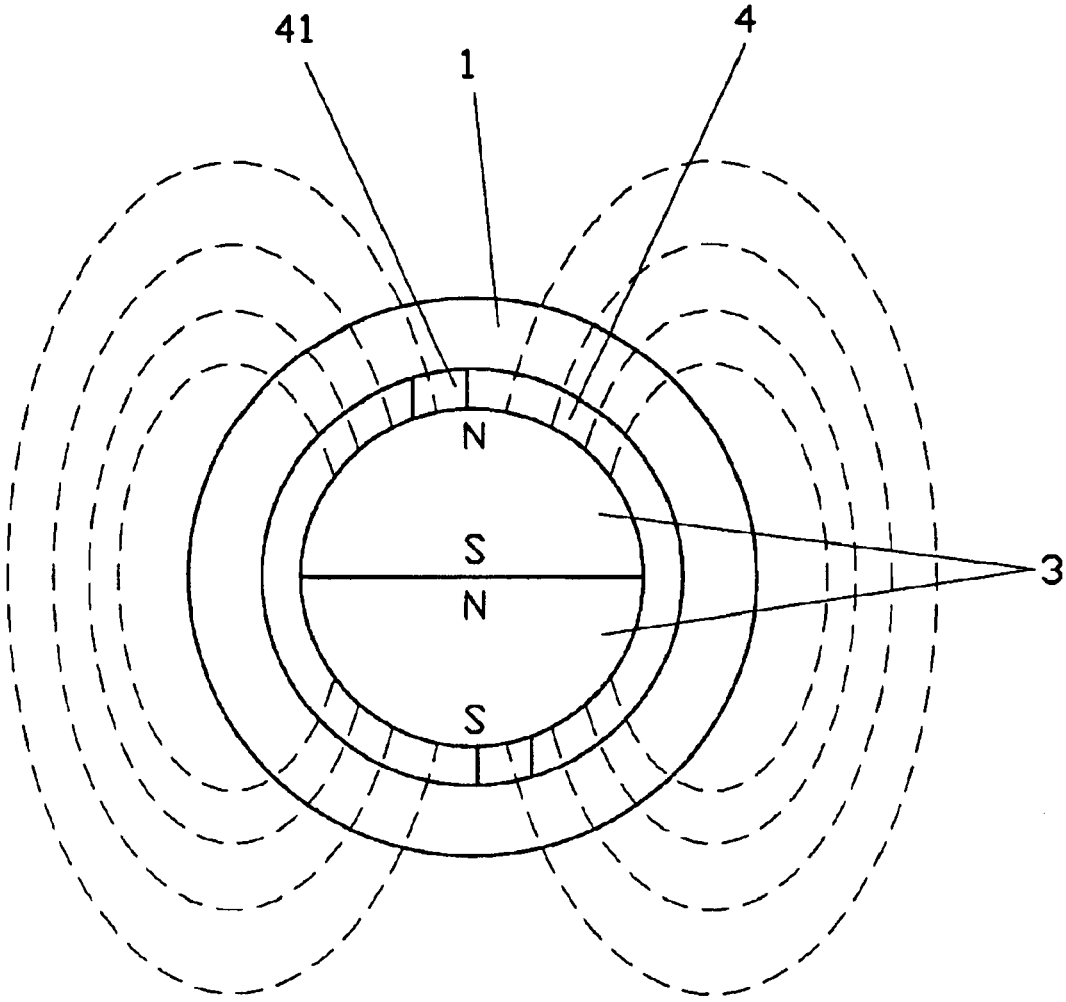
FIG. 3 is a view showing the magnetic field of a permanent magnet and a guiding bracket of the present invention.

Gasoline flows through the pipeline 21 of one nozzle 2 at one end of the sleeve 1 and into the gasoline routes formed by the guiding brackets 4, as shown in FIG. 3. Due to the continuously curved design of the saw-shaped edges 41 of the guiding brackets 4, the gasoline takes more time to travel out of the pipeline 21 of the other nozzle 2 and is magnetized more thoroughly. The gasoline is more flammable.

Figure 4:
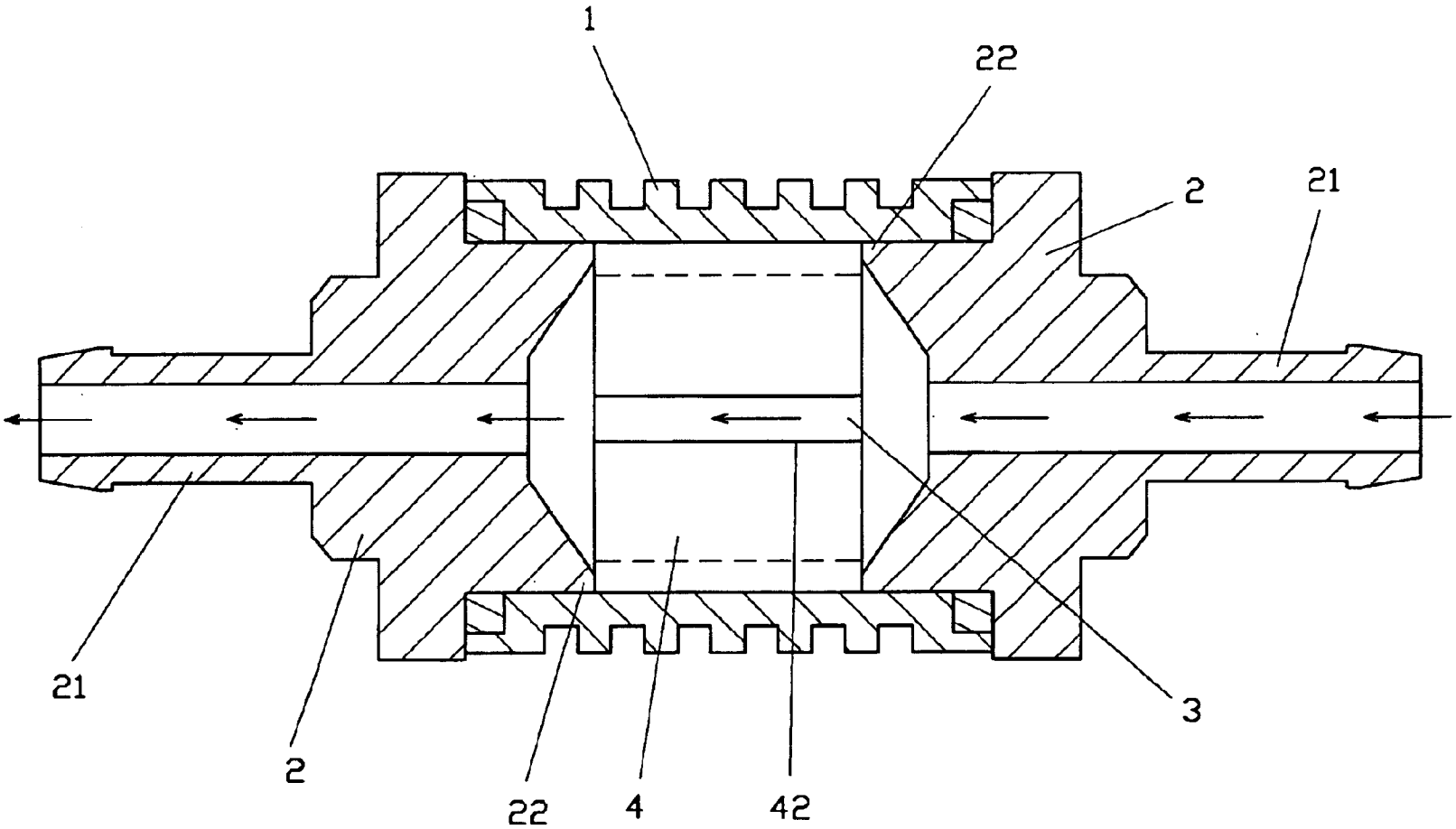
FIG. 4 is a cross-sectional view of a second embodiment of the present invention.

FIG. 4 shows a second embodiment of the present invention. Each guiding bracket 4 comprises a pair of straight edges 42 at respective ends. The two guiding brackets 4 are magnetized to wrap the round entity of the permanent magnets 3 outwardly. The straight edges 42 of the guiding brackets 4 are to form two straight gasoline routes to prolong the magnetization of gasoline.

Figure 5:
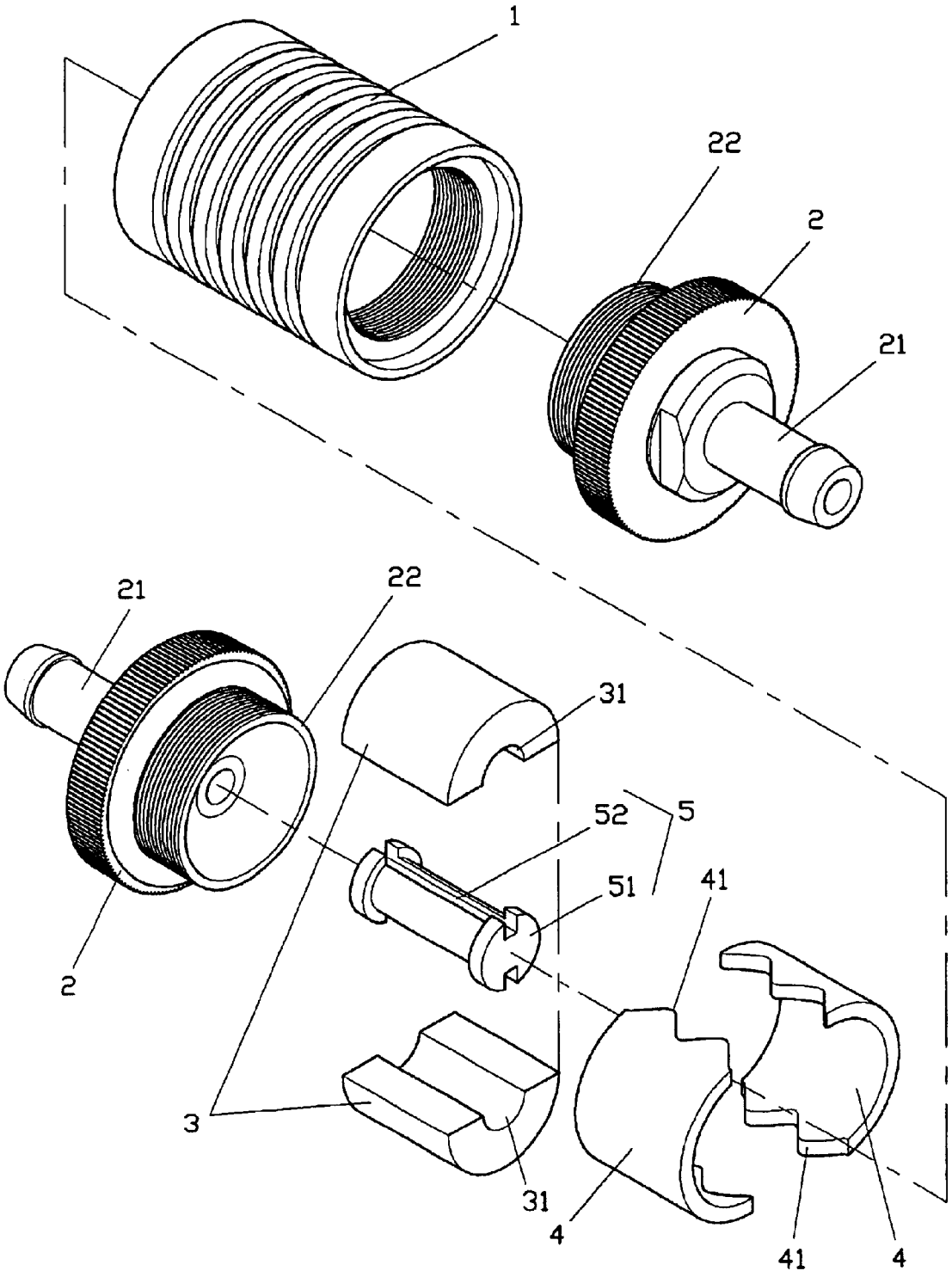
FIG. 5 is an exploded view of a third embodiment of the present invention.
Figure 6:
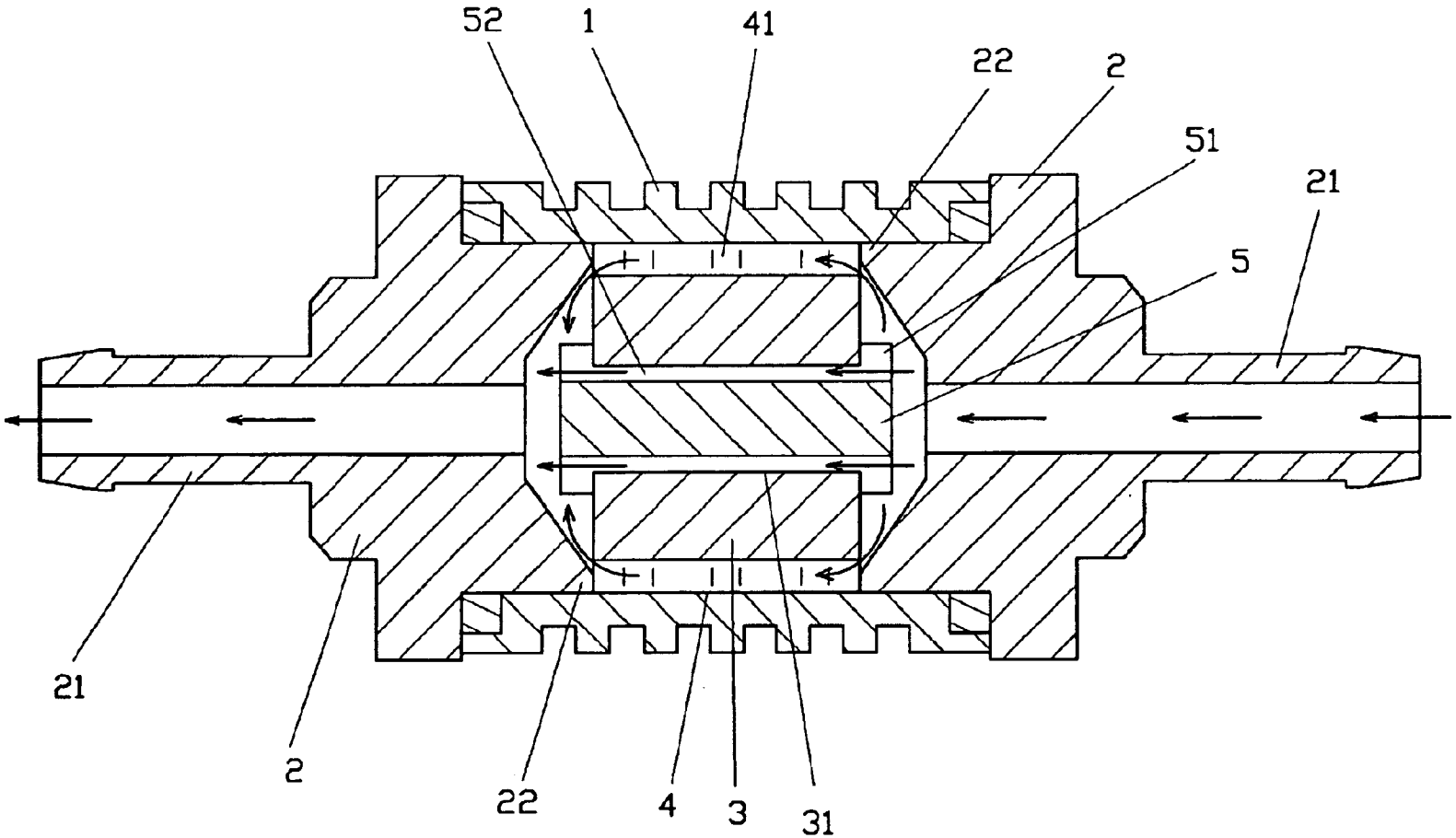
FIG. 6 is a cross-sectional view of the third embodiment of the present invention.

Furthermore, FIGS. 5 and 6 show a third embodiment of the present invention. The two permanent magnets 3 have a center hole 31 to accommodate a guiding post 5 therein. The guiding post 5 comprises a pair of stoppers 51 at respective ends and a pair of grooves 52 corresponding to each other in position. Thus, the gasoline drained into the pipeline 21 of one nozzle 2 will go through both the gasoline routes formed by the guiding brackets 4 and the grooves 52 of the guiding post 51. This increases the ability to burn the gasoline thoroughly.

I claim:

1. A magnetized device for an automobile fueling system comprising a sleeve, a pair of nozzles, a pair of semi-circular permanent magnets and a pair of semi-circular guiding brackets, wherein said permanent magnets and said guiding brackets are enclosed in said sleeve securely, said sleeve comprising inner threads at respective ends to secure said nozzles, each said nozzle comprising a pipeline axially extending from one end and a reduced neck at another end with threads thereon, and characterized by:

said guiding brackets being magnetized to wrap said permanent magnets outwardly, each said guiding bracket comprising a pair of edges at two ends, the combination of said guiding brackets forming a pair of gasoline routes with said edges.

2. The magnetized device for an automobile fueling system, as recited in claim 1, wherein said permanent magnets comprise a center hole to receive a guiding post therein, said guiding post comprising a pair of grooves corresponding to each other in position.

3. The magnetized device for an automobile fueling system, as recited in claim 1, wherein each said guiding bracket comprises a pair of saw-shaped edges at two ends, the combination of said guiding brackets forming a pair of continuously curved gasoline routes.

4. The magnetized device for an automobile fueling system, as recited in claim 1, wherein each said guiding bracket comprises a pair of straight edges at two ends, the combination of said guiding brackets forming a pair of straight gasoline routes.

* * * * *